US010309091B2

(12) United States Patent
McNamee

(10) Patent No.: US 10,309,091 B2
(45) Date of Patent: Jun. 4, 2019

(54) DECK RAILING ASSEMBLY

(71) Applicant: Steven V. McNamee, Argusville, ND (US)

(72) Inventor: Steven V. McNamee, Argusville, ND (US)

( * ) Notice: Subject to any disclaimer, the term of this patent is extended or adjusted under 35 U.S.C. 154(b) by 247 days.

(21) Appl. No.: 15/336,203

(22) Filed: Oct. 27, 2016

(65) Prior Publication Data

US 2018/0119407 A1 May 3, 2018

(51) Int. Cl.

*E04B 1/00* (2006.01)
*E04H 17/14* (2006.01)
*E04F 11/18* (2006.01)

(52) U.S. Cl.

CPC ..... *E04B 1/003* (2013.01); *E04F 11/1817* (2013.01); *E04H 17/1417* (2013.01); *E04H 17/1421* (2013.01); *E04H 17/1426* (2013.01); *E04F 2011/1819* (2013.01); *E04F 2011/1821* (2013.01); *E04H 2017/1447* (2013.01); *E04H 2017/1465* (2013.01)

(58) Field of Classification Search

CPC ..... E04H 17/1421; E04H 17/22; E04H 2017/1447; E04H 2017/1465; E04H 17/1417; E04H 17/1426; E04B 1/003; E04B 1/34336; E04F 15/02183; E04F 15/02; E04F 15/183; E04F 11/1817; E04F 2011/1819; E04F 2011/1821

USPC ..... 256/22, 65.02, 65.14, DIG. 5; 52/73, 52/79.6, 296, 480, 650.3

See application file for complete search history.

(56) References Cited

U.S. PATENT DOCUMENTS 4,188,019 A * 2/1980 Meredith ..... E04F 11/181 256/24
4,386,762 A * 6/1983 Collins ..... E04H 17/22 256/59
4,691,484 A * 9/1987 Wilson ..... E04B 1/003 52/184
5,313,756 A * 5/1994 Ways ..... E04B 1/003 404/35
5,625,987 A * 5/1997 Zamerovsky ..... E04B 1/003 403/217
5,713,171 A * 2/1998 Andres ..... E04H 17/1443 256/19
6,061,991 A * 5/2000 Dahl ..... E01D 19/103 256/21
6,209,267 B1 * 4/2001 Dantzer ..... E04B 5/12 52/480
6,299,142 B1 * 10/2001 Chaney ..... E04F 11/1812 256/65.12
6,655,726 B2 * 12/2003 Bergeron ..... B60J 7/102 296/100.01
6,883,786 B2 * 4/2005 Bebendorf ..... E04H 17/1421 256/19

(Continued)

*Primary Examiner* — Amber R Anderson
*Assistant Examiner* — Nahid Amiri
(74) *Attorney, Agent, or Firm* — Westman, Champlin & Koehler, P.A.; Theodore M. Magee

(57) ABSTRACT

A deck includes a railing formed of a hollow post and a peg that is press fit into the interior of the hollow post. A frame member has at least one hole passing from an exterior of the frame member to an interior of the frame member, wherein the peg is inserted in the hole and is secured to the frame member through frictional contact with surfaces on the interior of the frame member.

17 Claims, 11 Drawing Sheets

(56) References Cited

U.S. PATENT DOCUMENTS

| | | | | |
|---|---|---|---|---|
| 6,918,221 | B2 * | 7/2005 | Williams | E04B 5/026 52/578 |
| 7,134,647 | B2 * | 11/2006 | Graber | E04H 17/1443 256/65.02 |
| 7,232,114 | B2 * | 6/2007 | Platt | E04H 17/1413 256/65.04 |
| 7,344,122 | B2 * | 3/2008 | Gasaway | E04H 17/1413 256/65.01 |
| 7,360,754 | B2 * | 4/2008 | Robbins | E04H 17/1443 256/22 |
| 7,500,335 | B1 * | 3/2009 | Kjose | E04H 3/28 52/182 |
| 7,677,000 | B2 * | 3/2010 | Walker | E04F 11/1812 248/519 |
| 7,857,292 | B2 * | 12/2010 | Esposito | E04H 17/1443 256/22 |
| 8,601,756 | B2 * | 12/2013 | McNamee | E04B 5/10 52/177 |
| 8,919,742 | B2 * | 12/2014 | Williams, Sr. | E04H 17/16 256/65.11 |
| 9,243,396 | B2 * | 1/2016 | Klassen | E04B 1/003 |
| 9,470,041 | B2 * | 10/2016 | Ash | E04H 17/1413 |
| 2002/0194795 | A1 * | 12/2002 | Spite | E04B 5/026 52/79.1 |
| 2006/0175595 | A1 * | 8/2006 | Carnevali | E04H 12/2261 256/65.14 |
| 2010/0237308 | A1 * | 9/2010 | Lo | E04H 17/1417 256/26 |
| 2012/0211714 | A1 * | 8/2012 | Esposito | E04H 17/1443 256/65.02 |
| 2015/0014620 | A1 * | 1/2015 | Holmes | A01K 3/00 256/65.02 |
| 2015/0052845 | A1 * | 2/2015 | Desautels | E04C 3/36 52/650.3 |

* cited by examiner

DECK RAILING ASSEMBLY

BACKGROUND

Decks are platforms that extend off the sides of buildings. Typically, decks include a frame, decking that is supported by the frame and provides a floor, and railings that enclose the decking and protect people from falling off the deck. The railings include posts that are connected to and extend upward from the frame, top and bottom rails that extend between the posts and in-fills that extend between the top and bottom rails. There are many different types of in-fills including glass, woven meshes, and pickets or balusters.

The posts must be adequately secured to the frame to withstand the application of several hundred pounds of lateral force. The in-fills must be such that they prevent children from passing between the top and bottom rails.

The discussion above is merely provided for general background information and is not intended to be used as an aid in determining the scope of the claimed subject matter. The claimed subject matter is not limited to implementations that solve any or all disadvantages noted in the background.

SUMMARY

A deck includes a railing formed of a hollow post and a peg that is press fit into the interior of the hollow post. A frame member has at least one hole passing from an exterior of the frame member to an interior of the frame member, wherein the peg is inserted in the hole and is secured to the frame member through frictional contact with surfaces on the interior of the frame member.

In a further embodiment, a deck includes a first hollow post comprising a first wall with an opening from an interior of the first hollow post to an exterior of the first hollow post and a second hollow post comprising a second wall with an opening from an interior of the second hollow post to an exterior of the second hollow post. A bottom rail has a first notch at a first end and a second notch at a second end, wherein the first end is inserted in the opening of the first wall such that a portion of the first wall is in the first notch and the second end is inserted in the opening of the second wall such that a portion of the second wall is in the second notch.

In a still further embodiment, a deck includes a front top rail connected to a corner post and a side top rail connected to the corner post. A front rail cap is positioned over and connected to the front top rail and has an end positioned over the corner post. A side rail cap is positioned over and connected to the side top rail and has an end positioned over the corner post. A member is positioned between and separates the end of the front rail cap from the end of the side rail cap over the corner post.

DETAILED DESCRIPTION OF ILLUSTRATIVE EMBODIMENTS

Figure 1:
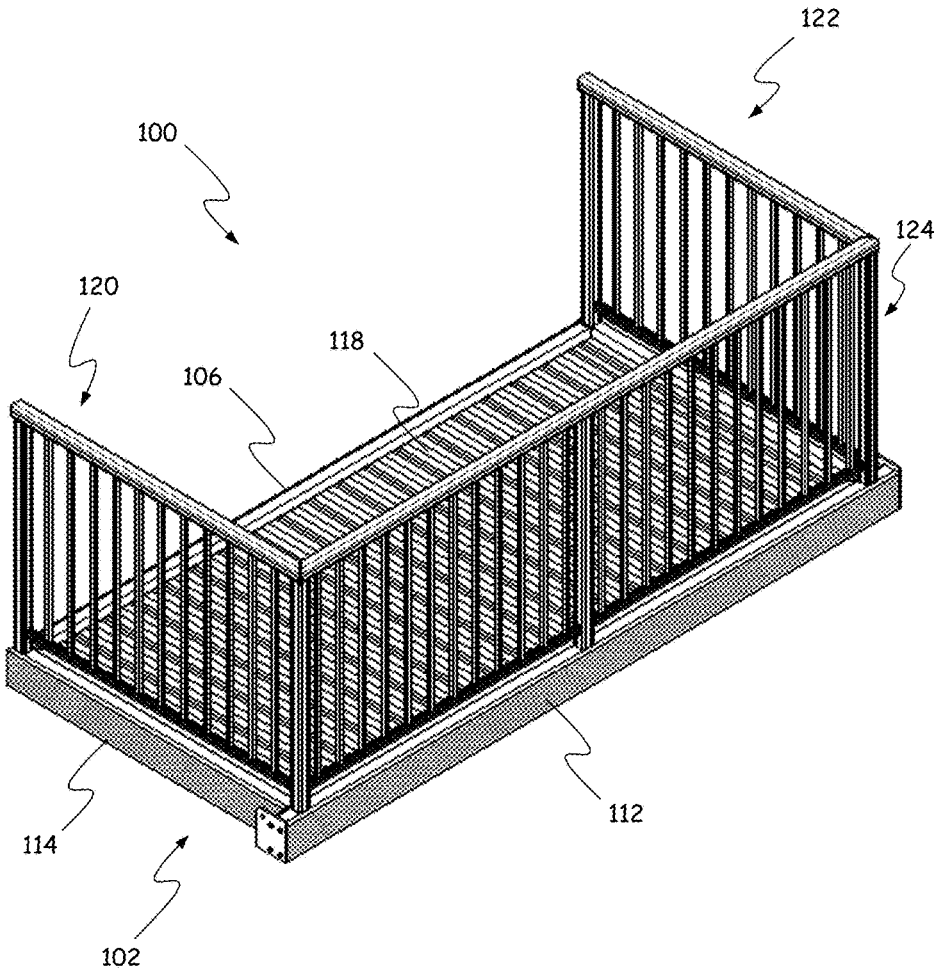
FIG. 1 is a perspective view of a deck in accordance with one embodiment.

The embodiments described below provide an aluminum deck that can be constructed without welding. In accordance with one embodiment, posts are formed of hollow extruded aluminum and are connected to the frame by an aluminum peg that is hydraulically driven into the hollow post to secure the peg through a friction fit with the interior of the hollow post. The peg is then inserted into a hollow frame member and bolts are used to flex the hollow frame member so that the frame member holds the peg in place. In further embodiments, each hollow post includes interior members that define four channels within the interior of the hollow post. The ends of these four channels can accept and secure a bolt that is screwed into the members that define the channels. These channels are used to secure the top rail to each post by passing a bolt through a top of the top rail and into one of the four channels. In some embodiments, the interior members define open channels and the peg is shaped so that portions of the peg fit into and extend out of each of the four open channels of the post.

In still further embodiments, the top and bottom rails provide a system that allows for in-fills to be removed and replaced whenever necessary. In the embodiments, the top rail has an interior and an open bottom and the bottom rail has an interior and an open top. The bottom rail is inserted into holes in the posts such that the bottom rail hangs on the posts without requiring a fastener. The bottom of an in-fill is inserted into the open top of the bottom rail and then the top rail is positioned over the in-fill such that the top of the in-fill extends through the open bottom of the top rail and into the interior of the top rail. The top rail is then secured to the tops of the posts using removable bolts to lock the in-fill in place. By removing the bolts that secure the top rail from the posts, the top rail and the in-fill can be removed and a new in-fill can be inserted into the bottom rail. The top rail can then be reattached to the posts. Thus, the assembly allows in-fills to be replaced without requiring the entire railing to be replaced.

In some embodiments, picket in-fills are constructed by cutting groves into the top and bottom of each picket and then capturing the tops and bottoms of the pickets in respective mesh-capture rails. The mesh-capture rails are then inserted into the interiors of the top and bottom rails.

In still further embodiments, a rail cap is placed over the top rail to provide a smooth surface and to hide the bolts that attaches the top rail to the posts. The ends of the rail caps are cut at 45 degree angles to form corners where two rails come together. To reduce exposed sharp edges at these corners, a flat member is inserted between the two rail caps at each corner. The flat member extends outside of the outer surface of the rail caps and rests on top of the posts. In some embodiments, the flat member includes a center tongue that is bent under one of the top rails to secure the flat member in place.

Figure 2:
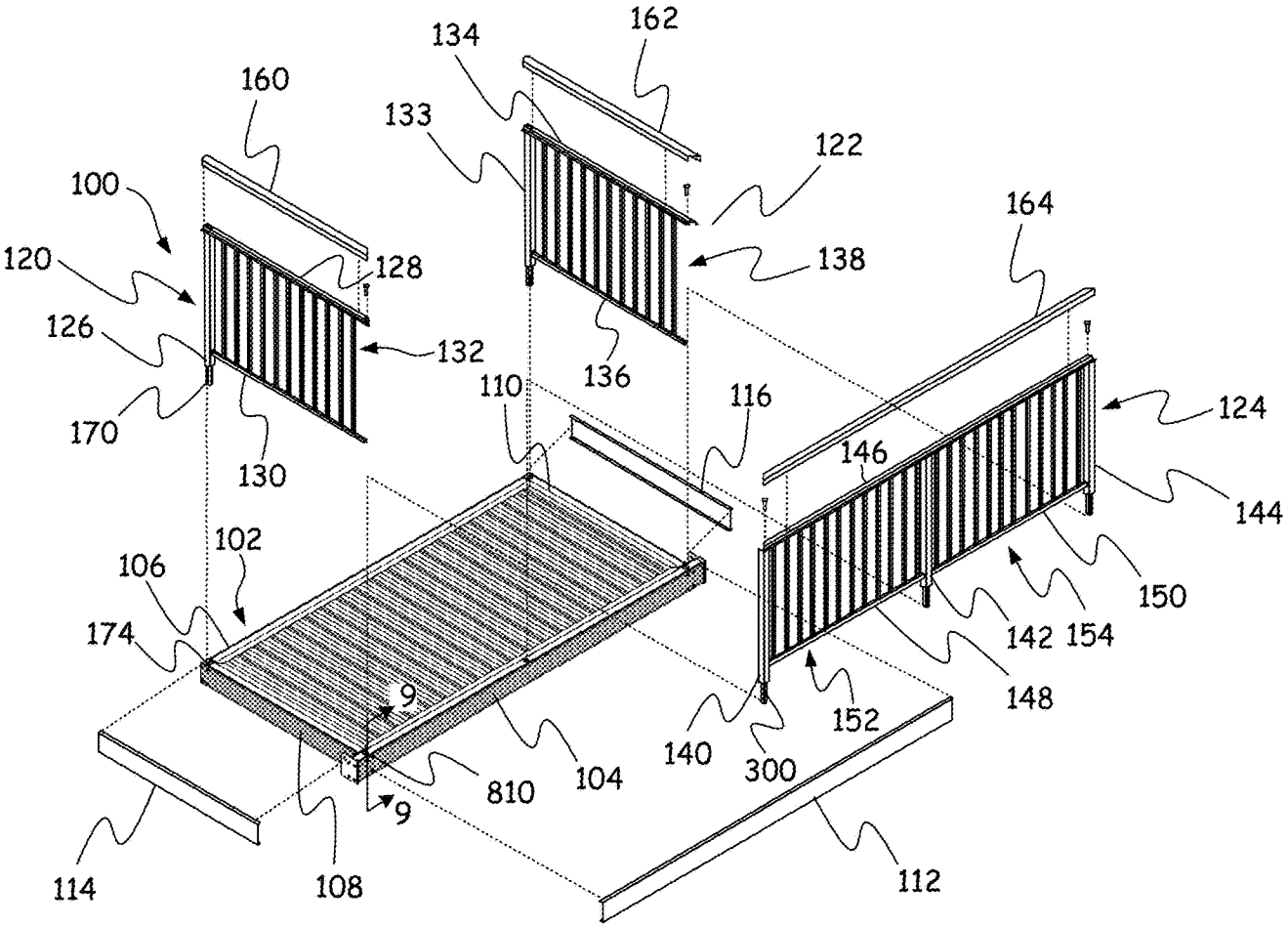
FIG. 2 is a partially exploded perspective view of the deck of FIG. 1.

FIG. 1 provides a perspective view and FIG. 2 provides a partially exploded perspective view of a deck 100 in accordance with one embodiment. Deck 100 includes a frame 102 consisting of frame members such as front header 104, back header 106 and side beams 108 and 110. Front header 104 and side beams 108 and 110 are covered with respective fascia pieces 112, 114 and 116, which snap onto the outer surfaces of front header 104 and side beams 108 and 110 without requiring welding or fasteners. In particular, fascia pieces 112, 114 and 116 include vertical portions that cover the outward facing surfaces of front header 104 and side beams 108 and 110 and top and bottom lateral surfaces that have inwardly extending nubs that snap into respective top and bottom groves that extend along the lengths of front header 104 and side beams 108 and 110. In some embodiments, fascia pieces 112, 114 and 116 are painted aluminum pieces and may be removed at any time and replaced with different color fascia pieces.

Frame 102 supports deck 118, which hangs from the edges of frame members 104, 106, 108 and 110. In particular, deck support pieces hang from each of the frame members and interconnected decking members are supported by the deck support pieces. The deck support pieces and the decking members are not welded together and any of the deck support pieces or decking member may be lifted out of the frame members and replaced if damaged.

Deck 100 also includes two side railings 120, 122 and a front railing 124. Side railing 120 includes post 126, top rail 128, bottom rail 130 and in-fill 132 in the form of a plurality of pickets. Side railing 122 includes post 133, top rail 134, bottom rail 136 and in-fill 138 in the form of a plurality of pickets. Front railing 124 includes posts 140, 142 and 144, top rail 146 and bottom rails 148 and 150. In addition, front railing 124 includes first in-fill 152 and second in-fill 154, which are both constructed of a plurality of pickets. Deck 100 also includes side rail caps 160 and 162 and front rail cap 164.

Each of posts 126, 133, 140, 142 and 144 include a respective peg such as peg 170 of post 126 and peg 300 of post 140, that fit within respective holes in a frame member such as hole 174 of side beam 108 and hole 810 of front header 104.

Figure 3:
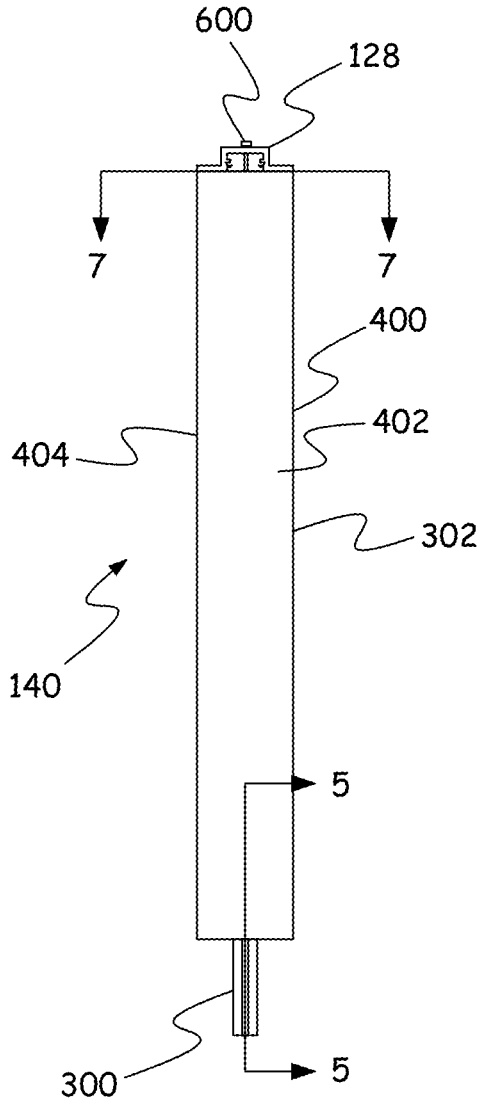
FIG. 3 is a front view of post 140.
Figure 4:
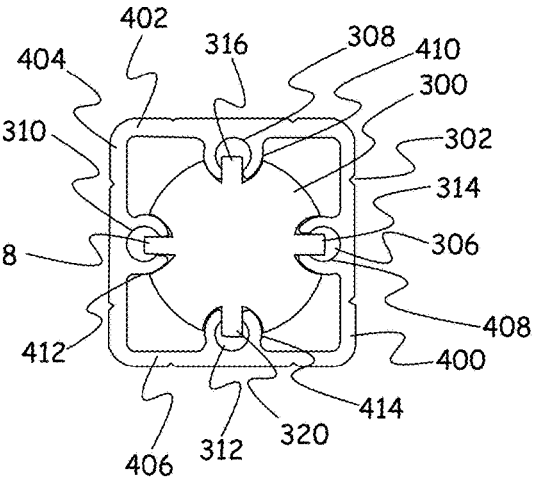
FIG. 4 is a bottom view of post 140.

FIG. 3 provides a front view of post 140 separate from railing 146 and 148, but connected to side top rail 128. FIG. 4 provides a bottom view of post 140 of FIG. 3. Post 140 is shown to include hollow extruded post 302 and solid peg 300. Hollow post 302 includes four walls 400, 402, 404 and 406. Although hollow post 302 is shown as being square in FIGS. 3 and 4, in other embodiments, hollow post 302 can take other shapes such as round. Four members 408, 410, 412 and 414 extend toward the interior of hollow post 302 from respective ones of the four walls. The four members each define a respective channel 306, 308, 310 and 312. In particular, each member 400, 402, 404, and 406 is constructed of two arms that together with a portion of walls 400, 402, 404 and 406 form a channel having an open side, such as open side 418 of channel 308.

Channels 306, 308, 310, and 312 are shown to be c-shaped in FIG. 4 and are each capable of receiving a threaded bolt at the top of post 140 such that as a threaded bolt is turned within one of the channels, the threads on the bolt cut into the member that defines the channel thereby securing the bolt to the member.

Figure 5:
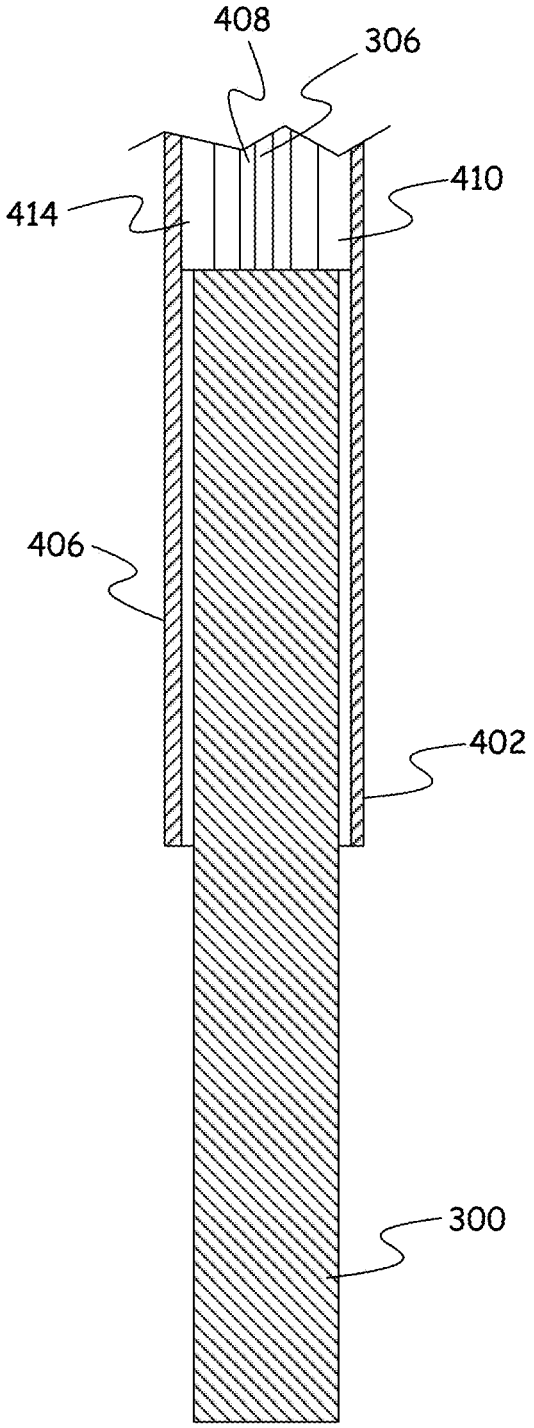
FIG. 5 is a sectional view of a portion of post 140.

Peg 300 is shown to be a solid peg that has a substantially circular shape with notches cut into it to form tabs 314, 316, 318 and 320 that fit into channels 306, 308, 310 and 312 and extend out of the open sides of channels 306, 308, 310 and 312. Peg 300 and tabs 314, 316, 318 and 320 are sized to form a friction fit with members 400, 402, 404 and 406. In accordance with one embodiment, the dimensions of the peg relative to hollow extruded post 302 are such that a hydraulic press is required to press fit peg 300 into hollow extruded post 302 during which members 400, 402, 404 and 406 and/or peg 300 are compressed resulting in a tight fit between peg 300 and hollow extruded post 302. FIG. 5 shows a sectional view of the portion of post 140 showing the position of peg 300 within hollow post 302.

Figure 6:
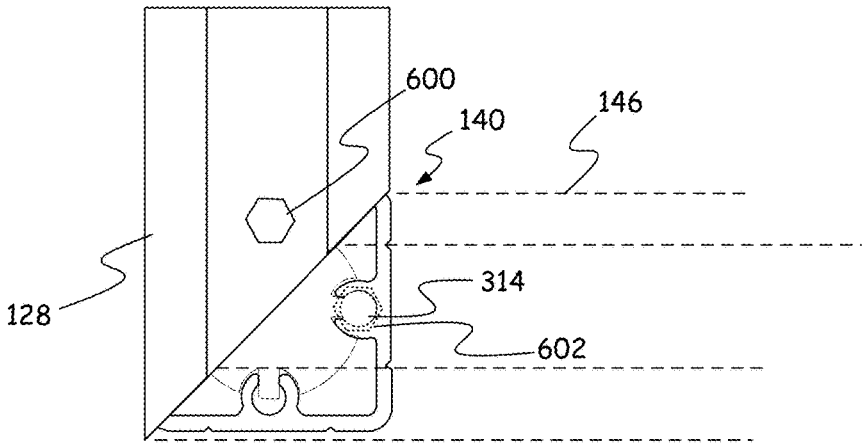
FIG. 6 is a top view of post 140 of FIG. 3.
Figure 7:
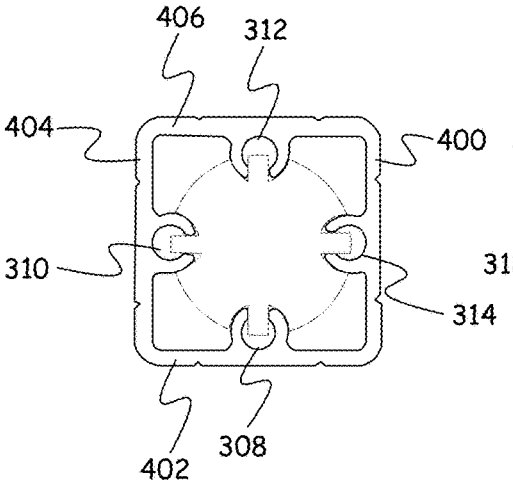
FIG. 7 is a top view of post 140 with the top rails removed.

FIG. 6 shows a top view of post 140 showing top rail 128 attached to post 140 and top rail 146 shown in phantom. Top rail 128 is attached to post 140 through a bolt 600 that passes into channel 312 and engages with member 414 to secure bolt 600 to post 140. Top rail 146 is attached to post 140 through a bolt 602 (shown in phantom) that passes into channel 314 and engages with member 408 to secure bolt 602 to post 140. FIG. 7 shows a top view of post 140 without top rails 128 and 146.

Figure 8:
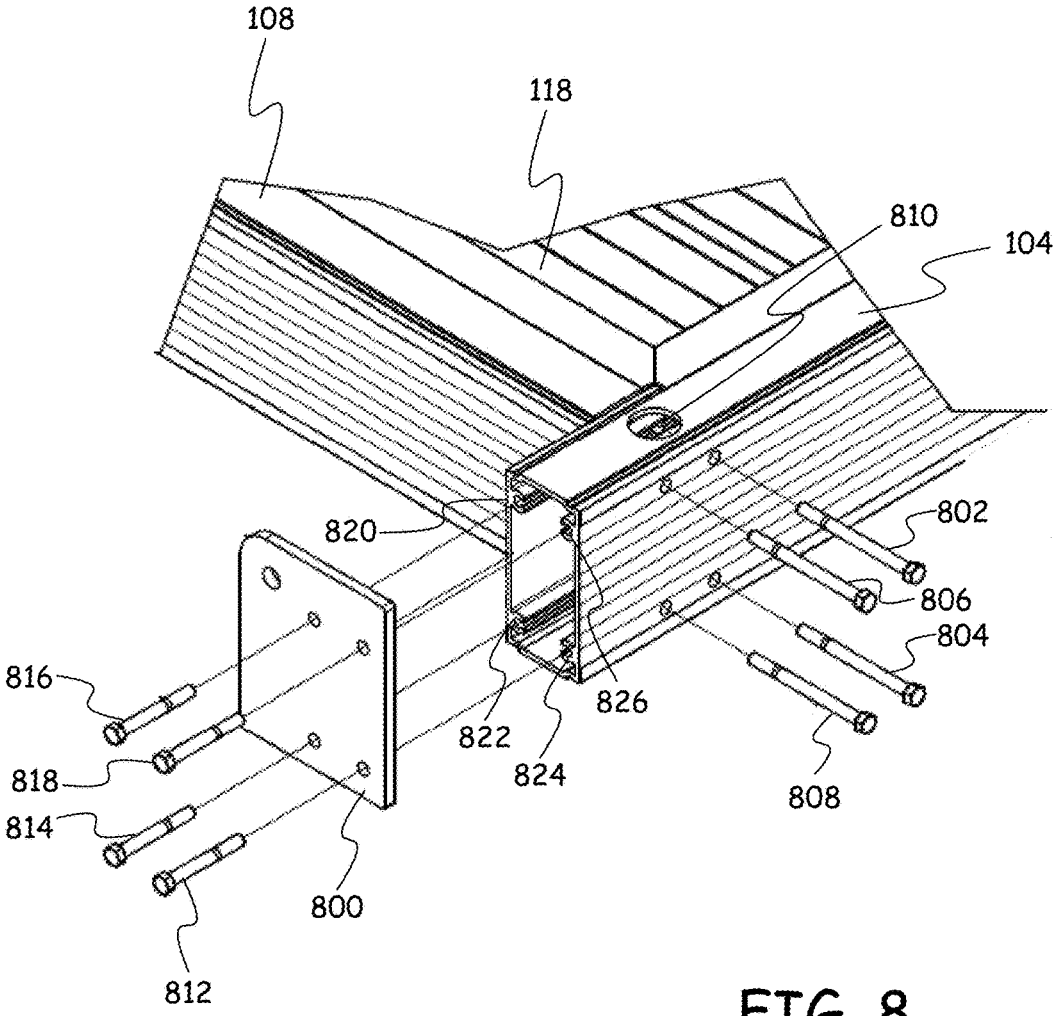
FIG. 8 is an enlarged view of the front left corner of the frame of the deck of FIG. 1.

FIG. 8 provides an enlarged view of the front left corner of frame 102 showing the connection between front header 104 and side beam 108. As shown in FIG. 8, front header 104 is a hollow extruded rectangular shape that includes four channels 820, 822, 824 and 826 that are defined by four respective members that extend along the length of header 104 and that are shaped to receive bolts such as bolts 812, 814, 816 and 818 for mounting a screw boss 800 to the end of header 104. Screw boss 800 can be used to support the front of deck 100, using a turnbuckle attached to the building.

In the embodiment of FIG. 8, beam 108 has the exact same structure as header 104 and thus also includes four members in its interior that define four respective channels for receiving bolts. In particular, beam 108 receives bolts 802, 804, 806 and 808, which pass through holes drilled in header 104, thread into the members defining that channels in beam 108 and thereby secure header 104 to beam 108. Header 104 also includes opening 810 that receives peg 300 of post 140 such that bolts 806 and 808 are on one side of peg 300 and bolts 802 and 804 are on the other side of peg 300 and such that bolts 802, 804, 806, and 808 are orthogonal to peg 300.

Figure 9:
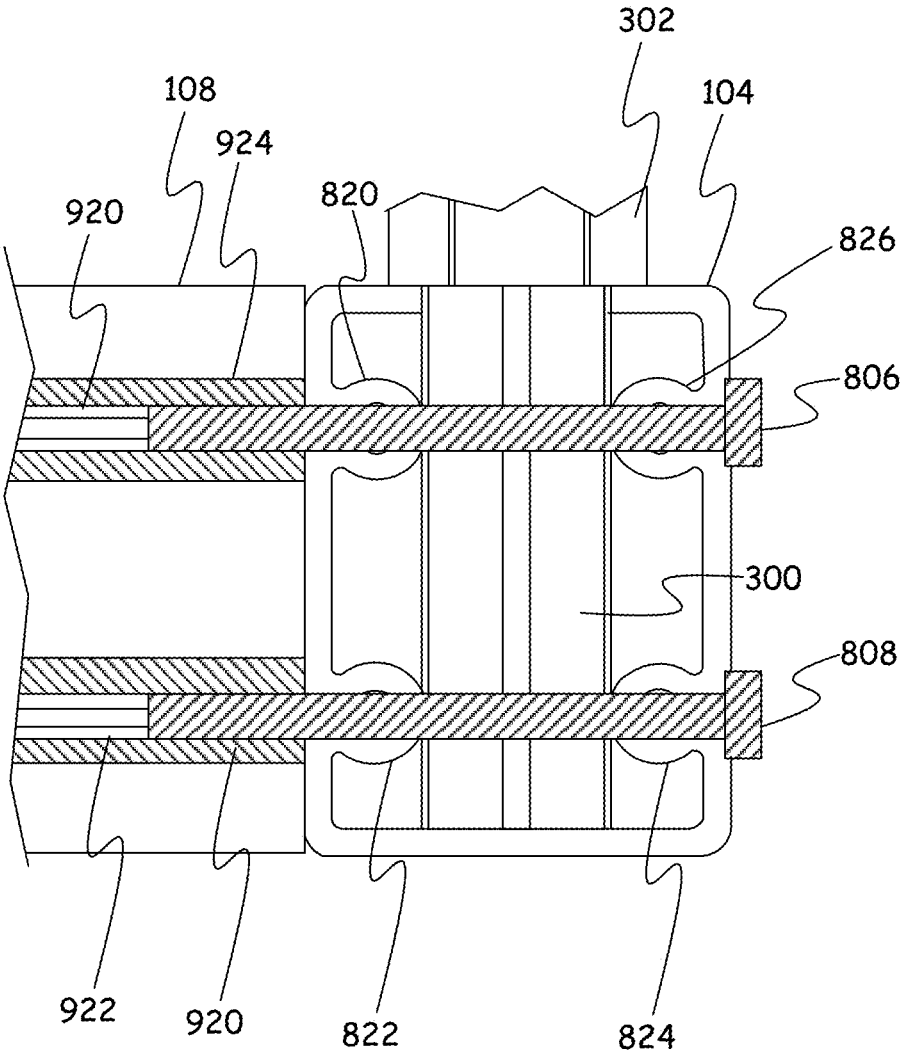
FIG. 9 is a sectional view of a portion of the deck showing the connections between the front header and a beam.

FIG. 9 shows a sectional view of the connection between header 104 and beam 108 as shown by lines 9-9 in FIG. 2. In FIG. 9, bolts 806 and 808 are shown passing through the interior of beam 104 and into channels 920 and 922 defined by members 924 and 926 of beam 108. As bolts 806 and 808 are screwed into channels 920 and 922, threads on bolts 806 and 808 cut into members 924 and 926 resulting in the heads of bolts 806 and 808 applying a force to the sides of header 104. This force causes header 104 to flex together such that the members that define channels 820, 822, 824 and 826 presses against peg 300 to secure peg 300 to header 104. In addition, bolts 802, 804, 806, and 808 prevent peg 300 from moving laterally along the length of header 104. Thus, bolts 802, 804, 806, and 808 not only mount header 104 to beam 108 but also secures peg 300 to header 104 without requiring welding of peg 300 or post 302 to header 104. Posts 126, 133 and 144 are similarly secured to the frame members of deck 100.

Figure 10:
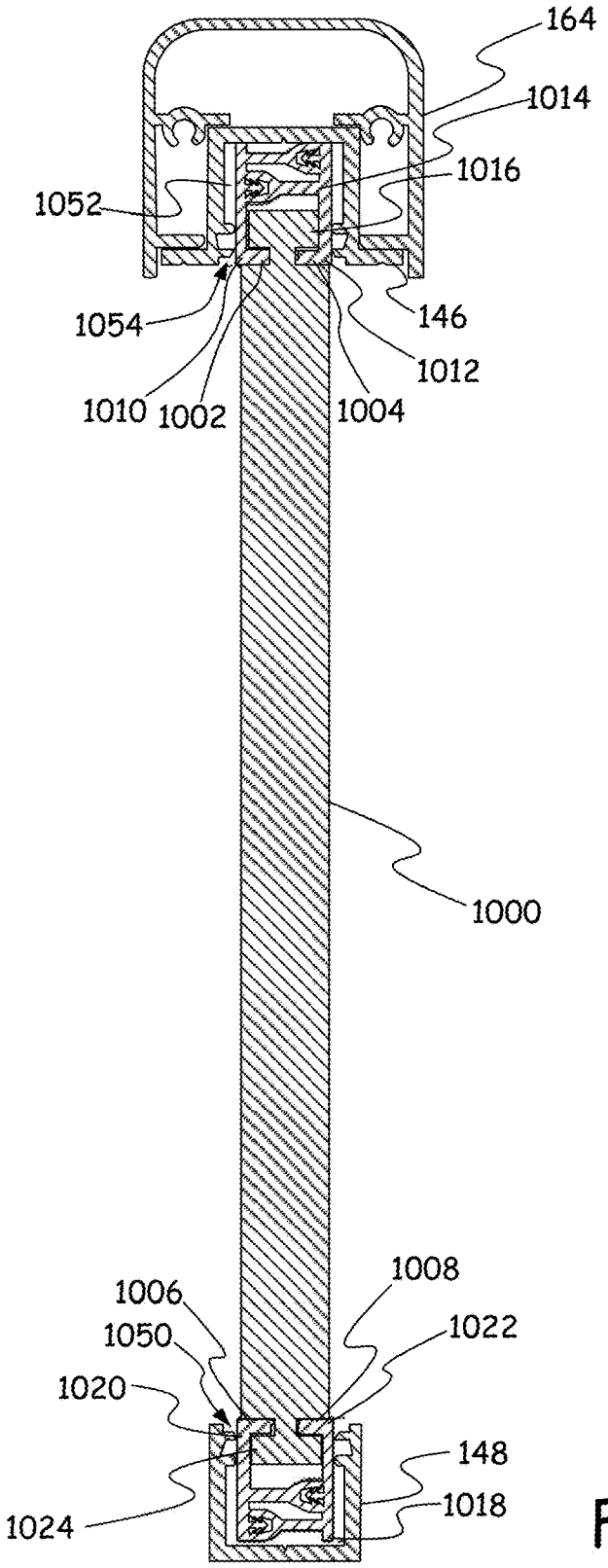
FIG. 10 is a side sectional view of a railing in accordance with one embodiment.

FIG. 10 provides a side sectional view of a picket 1000 of infill 152, bottom rail 148, top rail 146 and rail cap 164. Picket 1000 includes grooves 1002, 1004, 1006 and 1008. Grooves 1002 and 1004 receive legs 1010 and 1012, respectively of a mesh capture rail 1014 that runs the length of infill 152. Mesh capture rail 1014 is constructed of two pieces that are pressed together to place legs 1010 and 1012 within grooves 1002 and 1004. As the pieces are pressed together, they deform to lock the two pieces in place and to lock a top 1016 of picket 1000 within mesh capture rail 1014. A similar mesh capture rail 1018 has two legs 1020 and 1022 that are pressed into grooves 1006 and 1008 when the two pieces of mesh capture rail 1018 are pressed and locked together. This locks a bottom 1024 of picket 1000 within mesh capture rail 1018.

Mesh capture rail 1018 is then inserted in an interior of bottom rail 148 through the open top 1050 of bottom rail 148. Top rail 146 is then placed on top of mesh capture rail 1014 such that mesh capture rail 1014 is positioned in the interior 1052 of top rail 146 through open bottom 1054 of top rail 146. Cap 164 is then placed over top rail 146 and may be secured to top rail 146 using screws. Although only a single picket is shown in FIG. 10, all the pickets shown in each infill 132, 138, 152 and 154 are similarly captured within mesh captures that are in turn located within a top rail and a bottom rail.

Although FIG. 10 shows a plurality of pickets as the infill for deck 100, in other embodiments other infills are used such as glass and mesh. When a mess infill is used, the same mesh capture rails shown in FIG. 10 can be used with the mesh. When glass infills are used, the mesh capture rails are replaced with rubber rails that are secured to the tops and bottoms of the glass and that prevent the glass from moving within the top and bottom rails.

Figure 11:
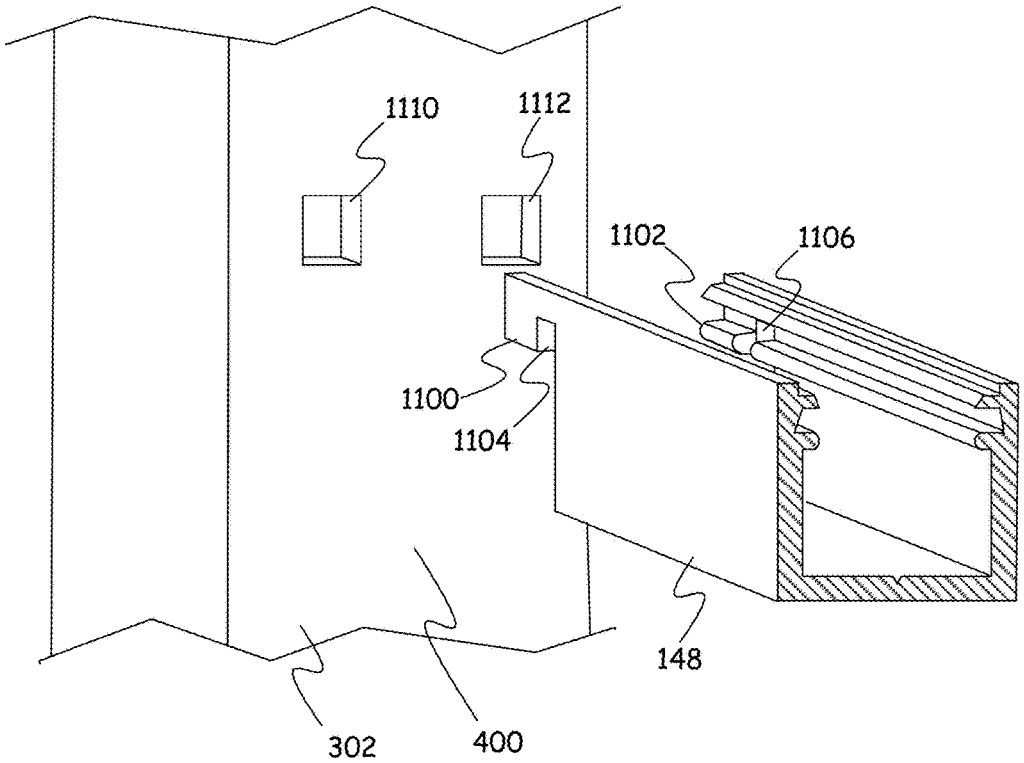
FIG. 11 is a perspective view showing a bottom rail disengaged from a post.
Figure 12:
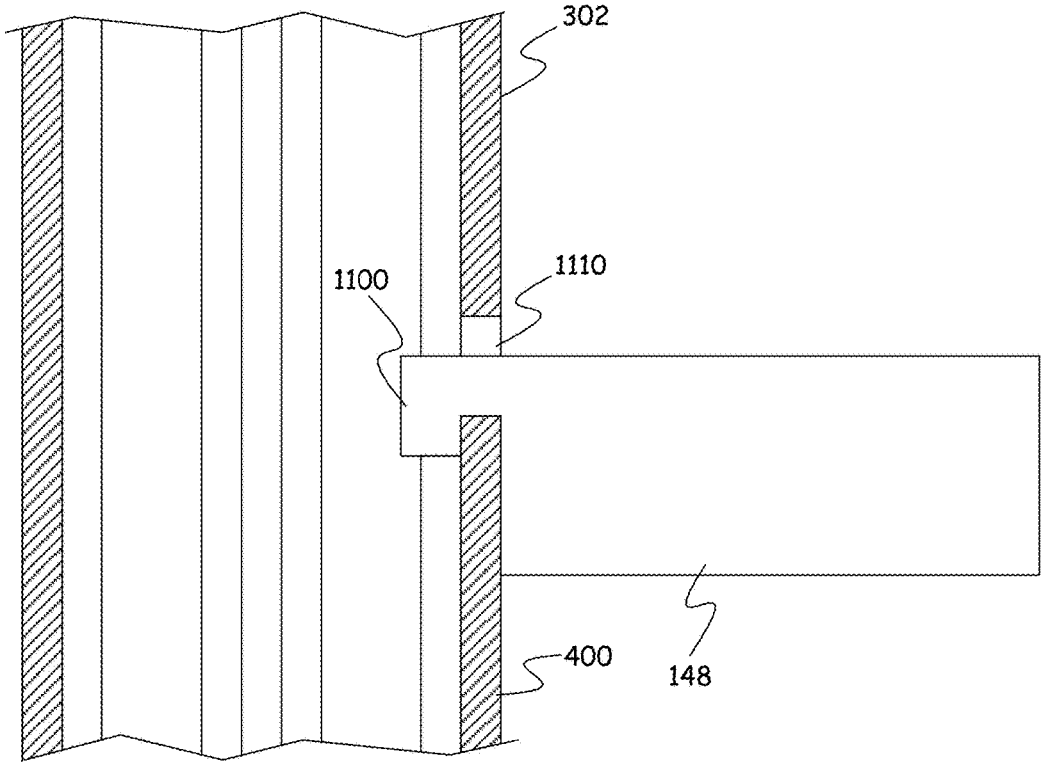
FIG. 12 is a front sectional view of a portion of a post showing a bottom rail engaged with the post.

FIG. 11 provides a perspective view showing bottom rail 148 disassembled from post 302 and FIG. 12 shows a sectional view of post 302 with bottom rail 148 assembled onto post 302. As shown in FIGS. 11 and 12, the ends of bottom rail 148 are cut to form two notches 1104 and 1106 that define two downwardly extending legs 1100 and 1102. Wall 400 of post 302 includes two holes 1110 and 1112 that extend from the exterior of post 302 to the interior of post 302 and that are large enough to accept legs 1100 and 1102. After legs 1100 and 1102 pass through holes 1110 and 1112, bottom rail 148 is dropped so that the surfaces defining notches 1104 and 1106 engage with wall 400 of post 302 thereby securing bottom rail 148 to post 302. Similar legs are found on the other end of bottom rail 148 and are used to mount bottom rail 148 to post 142. Bottom rails 150, 130 and 136 have a similar construction to bottom rail 148.

Figure 13:
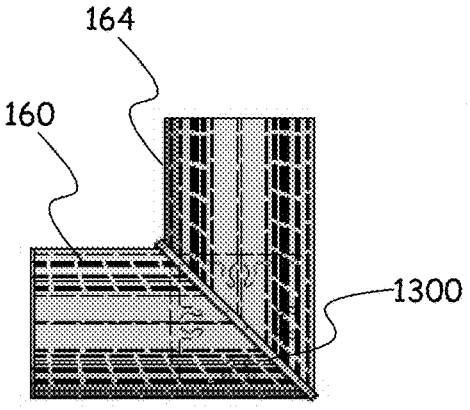
FIG. 13 is a top view of a corner where two rail caps come together.
Figure 14:
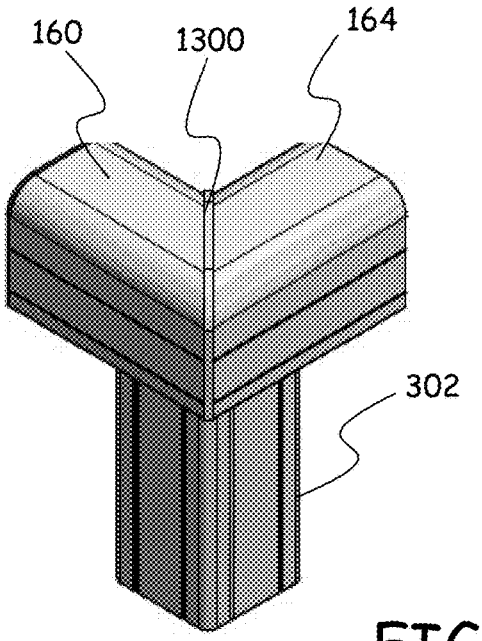
FIG. 14 is a perspective view of the corner of FIG. 13.

FIG. 13 shows a top view of a section of deck 100 where rail caps 160 and 164 meet. FIG. 14 shows a perspective view of the section shown in FIG. 13. As shown in FIGS. 13 and 14, the ends of rail caps 160 and 164 are cut at 45° angles. In accordance with some embodiments, a flat member 1300 is positioned between the ends of rail caps 160 and 164 and between the ends of top rail 146 and top rail 128 to prevent large gaps from appearing between rail caps 160 and 164. In accordance with one embodiment, the outer surface 1614 of member 1300 extends above the outer surfaces of rail caps 160 and 164.

Figure 15:
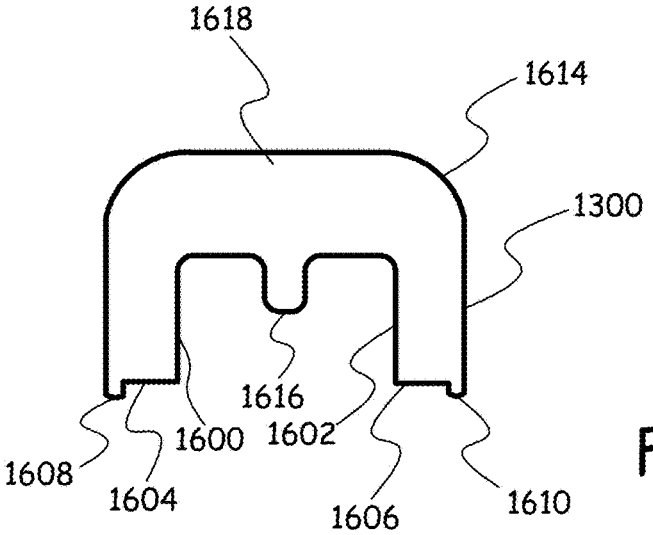
FIG. 15 is a front view of a member placed between two rail caps.

FIG. 15 provides a front view of flat member 1300 showing that flat member 1300 includes two legs 1600 and 1602 that include flat bottoms 1604 and 1606 and registration tabs 1608 and 1610, respectively. Registration tabs 1608 and 1610 are designed to hang over the corners of post 302 and flat surfaces 1604 and 1606 are designed to rest on the top of post 302. Outer surface 1614 of flat member 1300 has a rounded appearance. Flat member 1300 also includes a tongue 1616 extending down from the middle of a central member 1618. Tongue 1616 is designed to be bent so that it can be secured under one of top rail 146 or top rail 128.

Although the present invention has been described with reference to preferred embodiments, workers skilled in the art will recognize that changes may be made in form and detail without departing from the spirit and scope of the invention.

What is claimed is:

1. A deck comprising:

a railing comprising a hollow post having a wall and an interior;

a peg that is press fit into the interior of the hollow post, wherein the interior of the hollow post comprises at least one member extending from the wall to the interior and wherein the peg contacts the at least one member; and a frame member having at least one hole passing from an exterior of the frame member to an interior of the frame member, wherein the peg is inserted in the hole and is secured to the frame member through frictional contact with surfaces on the interior of the frame member.

2. The deck of claim 1 wherein the at least one member comprises two arms that together with a portion of the wall form a channel having an open side and wherein a portion of the peg is inserted into the channel and extends out through the open side of the channel.

3. The deck of claim 2 wherein the at least one member comprises four pairs of arms that form four respective channels, each with a respective open side, and wherein respective portions of the peg are inserted into each of the four channels and extend out through the open side of each of the four channels.

4. The deck of claim 2 further comprising a top railing that is mounted to the hollow post by a bolt that is secured in an end of the channel.

5. The deck of claim 1 wherein the peg is secured to the frame by flexing the frame member inward near the peg.

6. The deck of claim 5 wherein the frame member is flexed inward near the peg using bolts that are positioned on each side of the peg and that are oriented orthogonally to the peg.

7. The deck of claim 6 wherein the bolts are secured in channels in a second frame member to mount the frame member to the second frame member.

8. A deck comprising:

a first hollow post comprising a first wall with an opening from an interior of the first hollow post to an exterior of the first hollow post and an interior channel;

a second hollow post comprising a second wall with an opening from an interior of the second hollow post to an exterior of the second hollow post and an interior channel;

a top rail that is mounted to the first hollow post using a fastener that is secured to the interior channel of the first hollow post and is mounted to the second hollow post using a fastener that is secured to the interior channel of the second hollow post wherein the top rail has an interior that is open at a bottom of the top rail; and a bottom rail having a first notch at a first end and a second notch at a second end, wherein the first end is inserted in the opening of the first wall such that a portion of the first wall is in the first notch and the second end is inserted in the opening of the second wall such that a portion of the second wall is in the second notch wherein the bottom rail has an interior that is open at a top of the bottom rail.

9. The deck of claim 8 further comprising an in-fill that is located in the interior of the top rail and extends to and is located in the interior of the bottom rail.

10. The deck of claim 9 wherein the in-fill comprises a top mesh capture member positioned in the interior of the top rail, a bottom mesh capture member positioned in the interior of the bottom rail, and a plurality of pickets captured within the top mesh capture and the bottom mesh capture and extending between the top mesh capture and the bottom mesh capture.

11. The deck of claim 9 wherein the fasteners mounting the top rail to the first hollow post and the second hollow post are removable to allow the in-fill to be replaced with a different in-fill without replacing the hollow posts, the bottom rail or the top rail.

12. The deck of claim 10 wherein each picket comprises a front top groove and a back top groove and wherein a first leg of the top mesh capture is inserted in the front top groove and a second leg of the top mesh capture is inserted in the back top groove.

13. The deck of claim 12 wherein each picket comprises a front bottom groove and a back bottom groove and wherein a first leg of the bottom mesh capture is inserted in the front bottom groove and a second leg of the bottom mesh capture is inserted in the back bottom groove.

14. A deck comprising:

a front top rail connected to a corner post;

a side top rail connected to the corner post;

a front rail cap positioned over and connected to the front top rail and having an end positioned over the corner post;

a side rail cap positioned over and connected to the side top rail and having an end positioned over the corner post; and a member positioned between and separating the end of the front rail cap from the end of the side rail cap over the corner post.

15. The deck of claim 14 wherein the member comprises a flat member that is supported by the corner post.

16. The deck of claim 15 wherein the flat member extends outside of an exterior of the front rail cap and an exterior of the side rail cap.

17. The deck of claim 16 wherein the member further comprises a tongue that is bent under a portion of one of the front top rail and the side top rail.

* * * * *